US008205272B2

(12) United States Patent
Green et al.

(10) Patent No.: US 8,205,272 B2
(45) Date of Patent: Jun. 26, 2012

(54) PROTECTIVE HEAD GUARD

(75) Inventors: Michael Green, East Brunswick, NJ (US); Cliff Zatz, East Brunswick, NJ (US)

(73) Assignee: SportsGuard, LLC, East Brunswick, NJ (US)

( * ) Notice: Subject to any disclaimer, the term of this patent is extended or adjusted under 35 U.S.C. 154(b) by 6 days.

(21) Appl. No.: 12/381,230

(22) Filed: Mar. 10, 2009

(65) Prior Publication Data

US 2009/0222975 A1 Sep. 10, 2009

Related U.S. Application Data

(60) Provisional application No. 61/068,707, filed on Mar. 10, 2008, provisional application No. 61/124,241, filed on Apr. 15, 2008.

(51) Int. Cl.
*A42B 3/00* (2006.01)

(52) U.S. Cl. ..... 2/414; 2/425; 2/209.13

(58) Field of Classification Search ..... 2/425, 181, 2/181.2, 181.4, 181.8, 209.11, 209.12, 209.13, 2/175.1, 175.4, 195.1, 195.5, 410, 6.2, 411, 2/414, 417, 418, 422
See application file for complete search history.

(56) References Cited

U.S. PATENT DOCUMENTS

| | | | | | |
|---|---|---|---|---|---|
| 104,652 | A | * | 6/1870 | Scribner | 2/175.1 |
| RE22,023 | E | * | 2/1942 | Szumkowski | 2/181.8 |
| 3,133,289 | A | * | 5/1964 | Lipschutz | 2/195.6 |
| 3,315,273 | A | * | 4/1967 | Bullard | 2/418 |
| D267,287 | S | * | 12/1982 | Gooding | D29/122 |
| 5,035,009 | A | * | 7/1991 | Wingo et al. | 2/414 |
| 5,226,180 | A | * | 7/1993 | Leach | 2/411 |
| 5,269,026 | A | * | 12/1993 | McManus | 2/411 |
| D364,487 | S | * | 11/1995 | Tutton et al. | D29/122 |
| D364,496 | S | * | 11/1995 | Lejuez | D2/892 |
| 5,882,205 | A | * | 3/1999 | Peterson | 434/251 |
| 5,887,289 | A | * | 3/1999 | Theoret | 2/425 |
| 5,926,849 | A | * | 7/1999 | Boyle | 2/181.8 |
| 5,987,649 | A | * | 11/1999 | Robertson | 2/195.5 |
| 6,112,332 | A | * | 9/2000 | McCormick | 2/181 |
| D458,737 | S | * | 6/2002 | Fuerst | D2/892 |
| 7,028,344 | B2 | * | 4/2006 | Toth | 2/413 |
| 7,096,512 | B2 | * | 8/2006 | Blair | 2/410 |
| D560,051 | S | * | 1/2008 | Robinson | D2/882 |
| D569,583 | S | * | 5/2008 | Robinson | D2/882 |
| 2004/0226078 | A1 | * | 11/2004 | Lahman et al. | 2/413 |
| 2006/0168712 | A1 | * | 8/2006 | Mazzoccoli et al. | 2/411 |
| 2008/0010721 | A1 | * | 1/2008 | Campbell et al. | 2/181.4 |
| 2010/0083421 | A1 | * | 4/2010 | Cho | 2/171.2 |

* cited by examiner

*Primary Examiner* — Khoa Huynh
*Assistant Examiner* — Sally Cline

(57) ABSTRACT

A protective insert adapted to convert a standard baseball cap into a protective head guard, while maintaining the cap's desired attributes, such as comfort and stability. The protective insert of the present invention in combination with a baseball cap, not only protects a wearer from head injuries caused by impact force, but also has the attributes of stability, light weight and comfort so that it may be worn for extended periods during more intense activity than conventional baseball helmets.

8 Claims, 8 Drawing Sheets

PROTECTIVE HEAD GUARD

This application claims the benefit of U.S. Provisional Application No. 61/068,707 filed Mar. 10, 2008, entitled Protective Head Guard, by M. Green et al., which application is hereby incorporated herein by reference in its entirety. This application further claims the benefit of U.S. Provisional Application No. 61/124,241, filed Apr. 15, 2008, also entitled Protective Head Guard, by M. Green et al., which application is also hereby incorporated herein by reference in its entirety.

FIELD

This invention relates to the field of protective headgear. More specifically, protective headgear for sports, such as baseball.

BACKGROUND

Various activities, such as contact sports, and in particular baseball present a risk of head injury. Baseball helmets are commonly used by batters in league play to protect against a hard thrown baseball pitch or bat deflected ball. Baseball batters' helmets are constructed of a hard plastic shell with a crown portion, a forwardly projecting bill and rigid earflaps extending downwardly and forwardly to protect the sides of the head. Some helmets are fitted with additional face protectors, particularly where the player may be prone to re-injury from being struck on the side of the face with a pitched ball.

Such helmets, however, are generally not used by players other than batters (e.g., players in the field) because they are heavy, tend to fall off during vigorous activity, are cumbersome, and are uncomfortable when worn for more than short periods of time. Baseball infielders and outfielders generally where only a baseball cap with a bill to block the sun. They are generally constructed of fabric. Such baseball caps, are comfortable, will not fall off during vigorous activity, and protect the player's eyes from the sun, but provide little if any head protection.

What is needed is a lightweight baseball-style cap, that is comfortable, ventilated, stable and which can be worn for long time periods and that also provides protection from head impact, such as impact from a baseball.

SUMMARY

The current invention relates to a protective insert adapted to convert a standard baseball cap into a protective head guard, while maintaining the cap's desired attributes, such as comfort and stability. The protective insert of the present invention in combination with a baseball cap, not only protects a wearer from head injuries caused by impact force, but also has the attributes of stability, light weight and comfort so that it may be worn for extended periods during more intense activity than conventional baseball helmets. As such, it is suitable to be worn by baseball players on the field. It is also recommended for use in other sports and activities where head protection is recommended.

BRIEF DESCRIPTION OF THE FIGURES

These and other features, aspects, and advantages of the present invention will become better understood with regard to the following description, appended claims, and accompanying drawings where:

DETAILED DESCRIPTION

The head guard of the invention comprises a light-weight, impact-dispersing form adapted for insertion and fixation into a baseball caps. The head guard—baseball cap arrangement of the invention is worn by users to protect from head impact. Further, the head guard—baseball cap arrangement of the invention is stable and can be worn during vigorous activity, without becoming displaced, unlike a standard plastic helmet. The head guard—baseball cap arrangement of the invention is also lightweight, well ventilated and comfortable so that it may be worn for extended periods in hot weather and sun, unlike a standard plastic helmet.

Standard baseball caps for use in the invention are the typical soft cap with a long, stiffened and curved peak (also referred to as a bill) and it is worn by men, women and children. Caps used in the invention preferably comprise a sweat band around the inner portion of the cap. Adjustable caps for use in the invention may have a plastic, Velcro, or elastic adjustor so that it can be quickly adjusted to fit any wearer. Fitted caps of predetermined head size are also suitable for use with the head guard of the invention. Preferably, the cap is worn with the peak over the eyes. When worn in front, the peak is functional for blocking the sun. The major athletic cap manufacturers include Nike and New Era.

Figure 1:
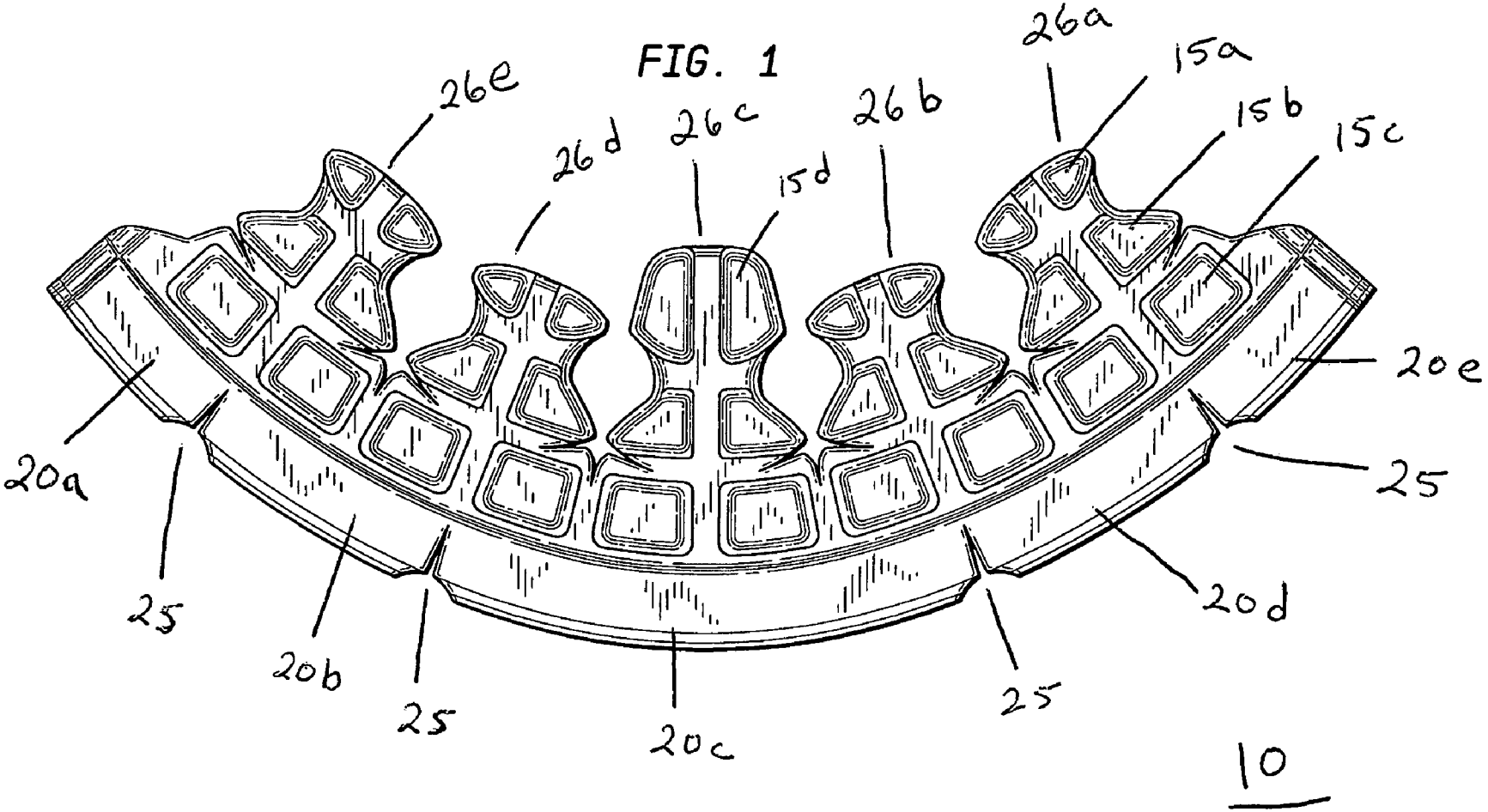
FIG. 1 depicts a head guard of the invention in an elongate, flat, non-operative configuration.
Figure 2:
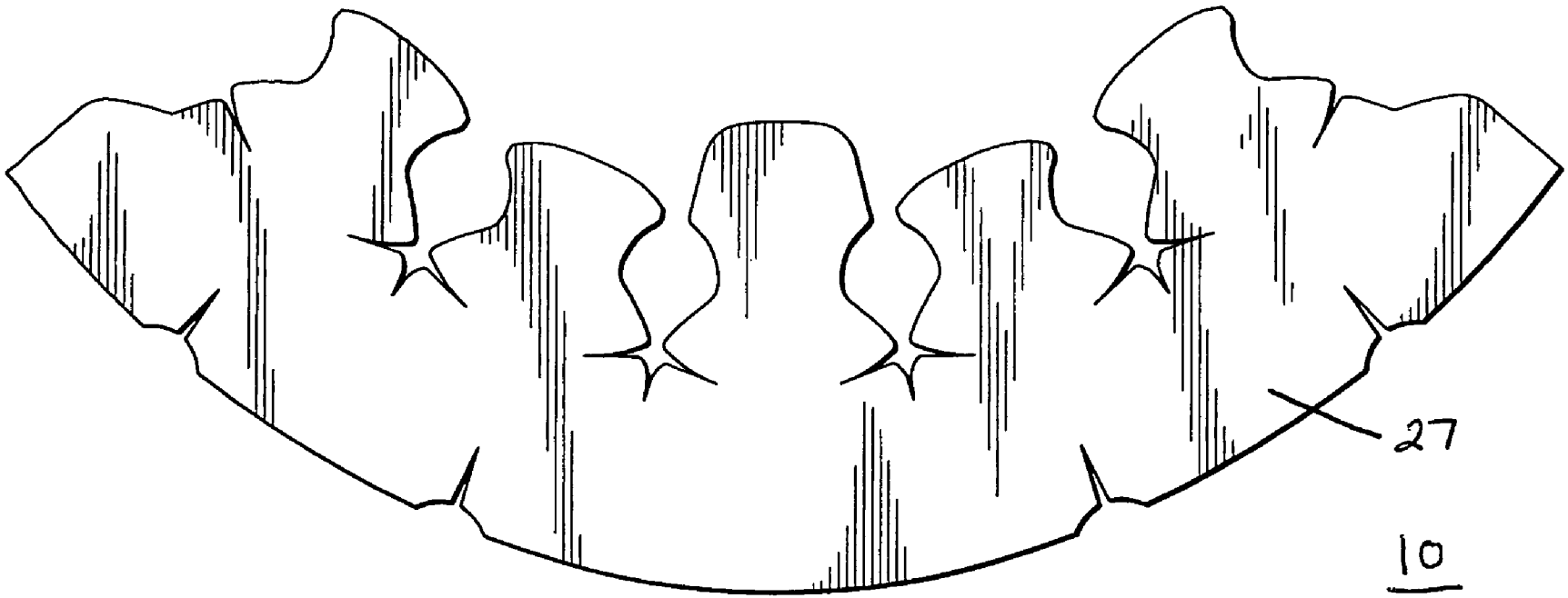
FIG. 2 depicts the reverse side of a head guard of the invention.

FIGS. 1-8 depict an embodiment of the head guard of the invention 10. Head guard 10 is adapted to be inserted into standard baseball cap 30, (see FIGS. 3-5) comprising sweat band 35. Head guard 10 comprises a light-weight, shock-absorbing fabric or material, such as foam rubber gel foam or rubberized gel foam, preferably of about 1 mm to about 20 mm in thickness. Head guard 10 optionally comprises protrusions 15*a*-15*d*, which are intended to distribute impact force. The shape and design of optional protrusions 15*a*-15*d* depend on the activity for which the head guard is to be used. FIG. 2 depicts the reverse side of head guard 10, comprising flat surface 27.

Figure 3:
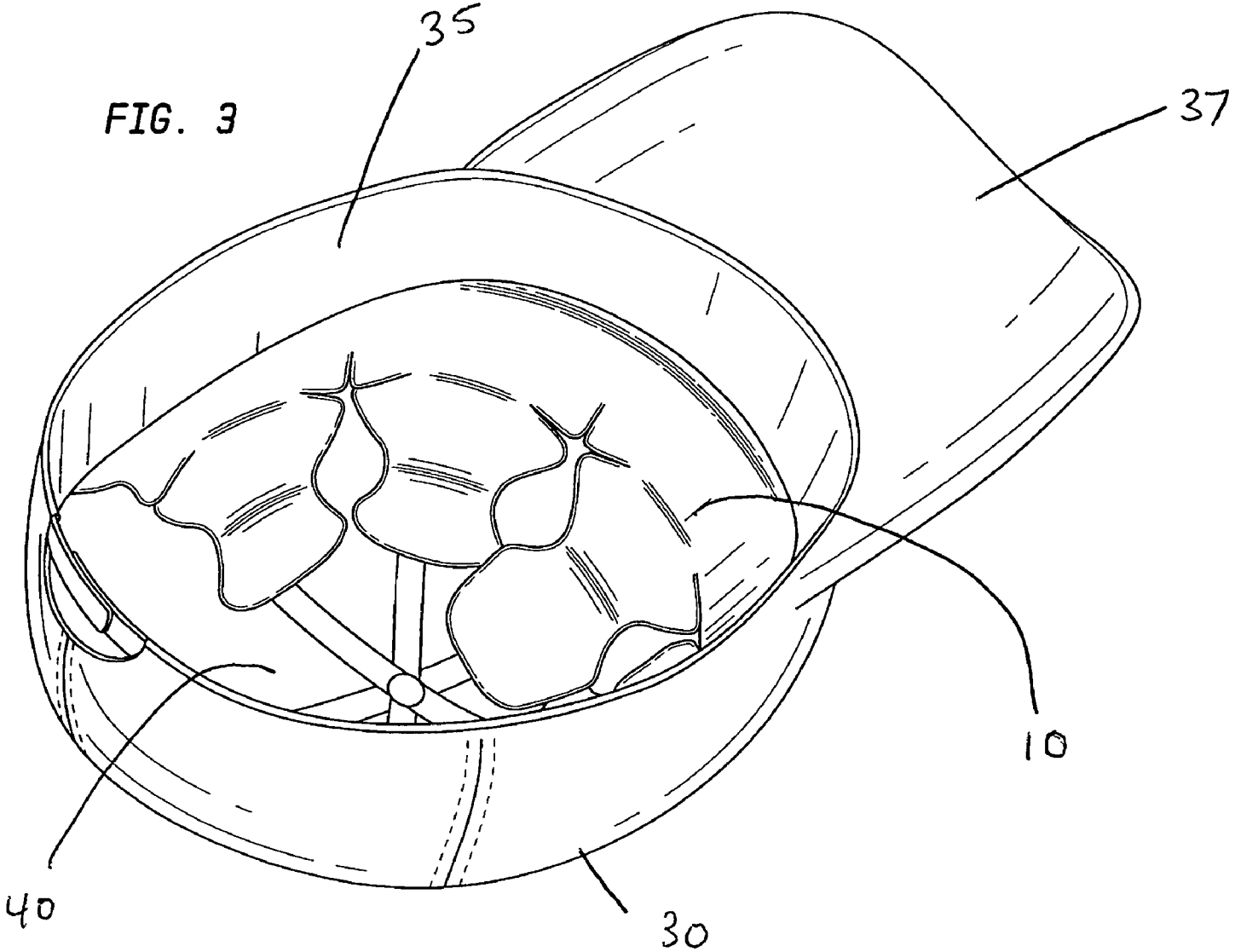
FIG. 3 depicts a head guard—baseball cap arrangement of the invention.

Head guard 10 is stabilized and fixed within cap 30, as shown in FIG. 3, by insertable sections 20*a*-20*d*, which insertable sections are designed and adapted for insertion and fixation between sweatband 35 and inner portion 40 of cap 30. Cap 30 comprises optional bill or peak 37. Insertable sections 20*a*-20*d* are separated by notches 25. When head guard 10 is so affixed within cap 30 by insertable portions 20*a*-20*d*, the user may engage in intense activity without worry that head guard 10 may displace from position within cap 30.

Figure 4:
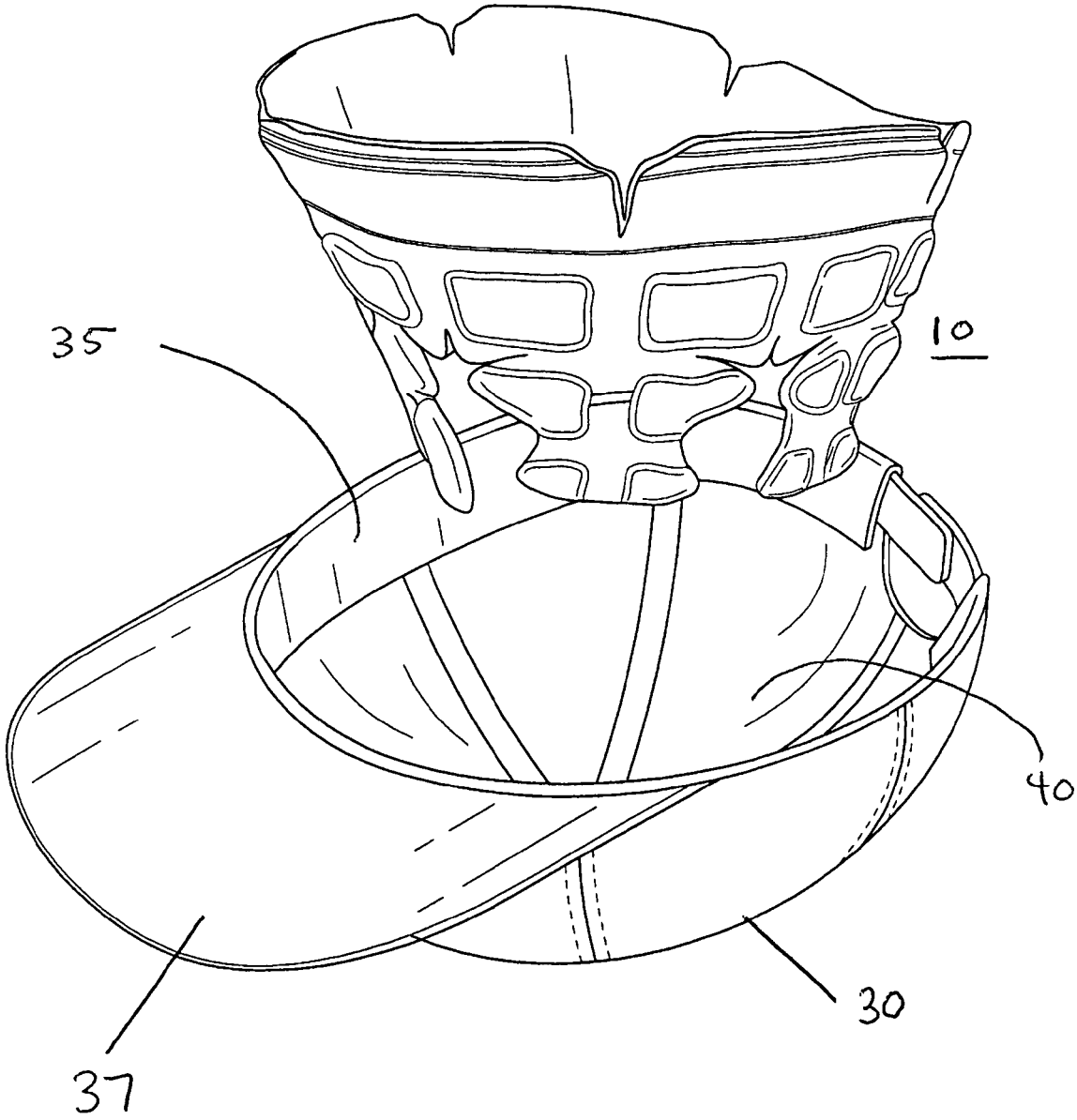
FIGS. 4-7 depict the head guard of the invention conformed in a conical shape and insertion into a baseball cap to construct a head guard—baseball cap arrangement of the invention.

Protection flaps 26*a*-26*e* permit the user to conform head guard 10 into a conical shape, as shown in FIG. 4, such that it may be inserted into baseball cap 30. In this design, the head guard of the invention comprises areas for ventilation. In one embodiment, insertable sections 20*a*-20*d* may be thicker or thinner than protection flaps 26*a*-26*e* to maximize ease of insertion into the cap's sweatband and maximize stability and protection.

Figure 5:
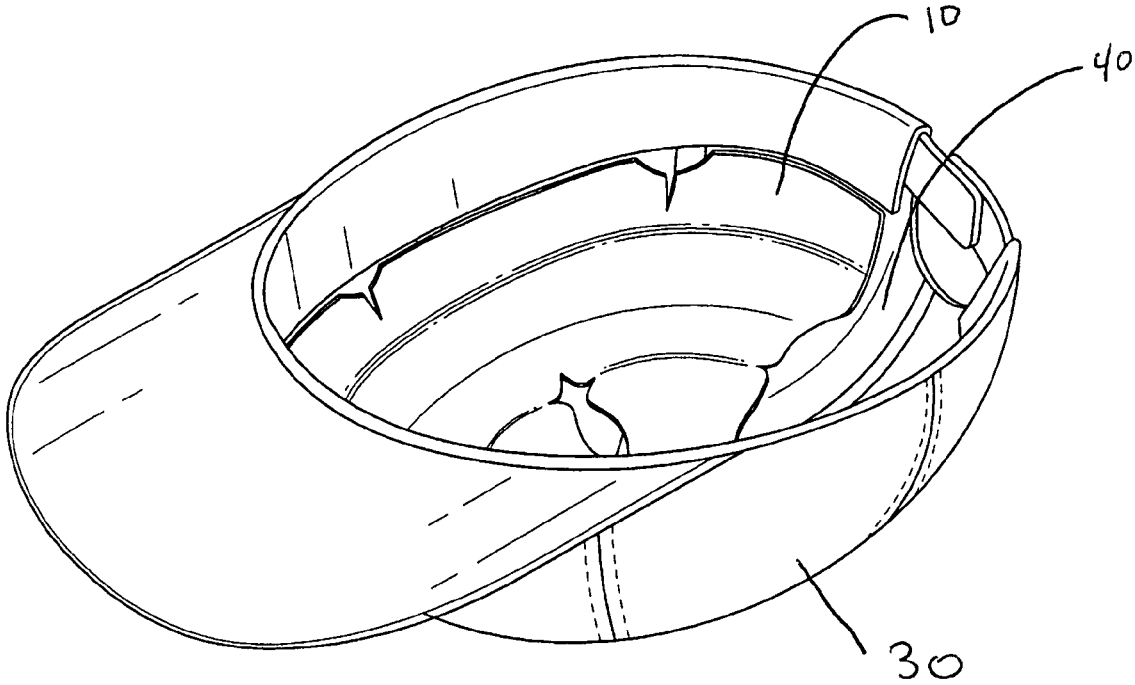
Figure 6:
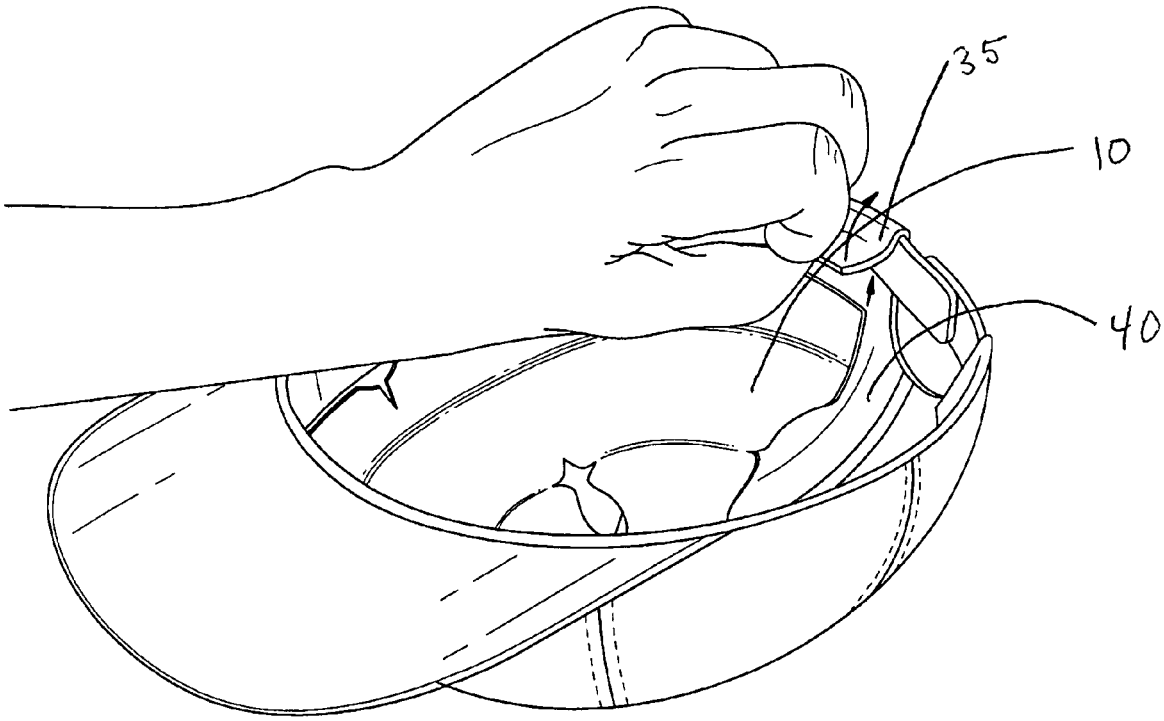
Figure 7:
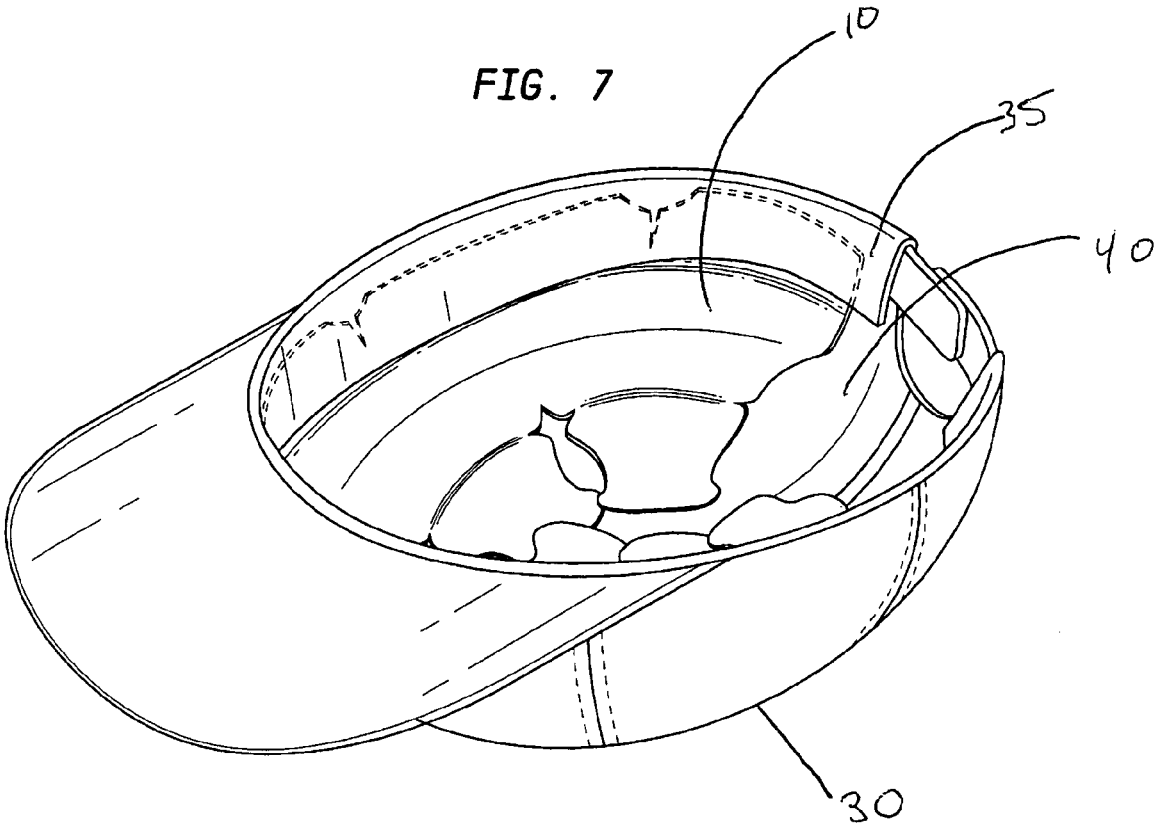
Figure 8:
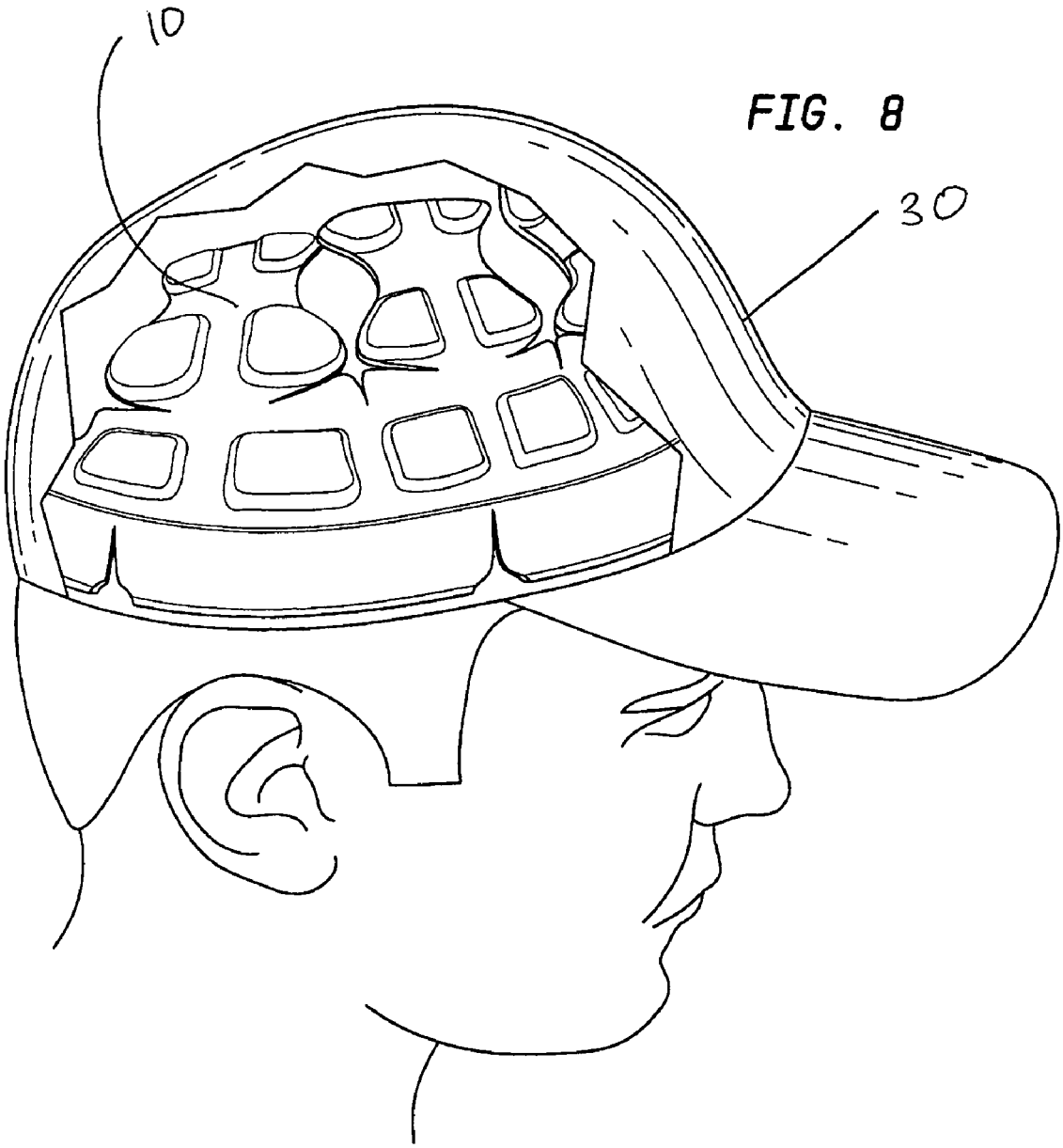
FIG. 8 depicts a user wearing a head guard—baseball cap arrangement of the invention.

FIGS. 4-7 depict insertion of head guard 10 into baseball cap 30. Referring to FIGS. 4-5, the user conforms head guard 10 conically, and inserts head guard 10 within cap 30, such that insertable portions 20*a*-20*e*, are directly below sweatband 35. As shown in FIGS. 6-7, sweatband 35 is lifted, insertable portions 20*a*-20*e* are inserted between sweatband 35 and inner portion 40, and then sweatband 35 is folded back into position, over insertable portions 20*a*-20*e*, such that insertable portions 20*a*-20*e* are fixed between sweat band 35 and inner portion 40 of cap 30. As shown in these FIGS., the larger middle flap 20*d* is positioned in the center of the front of cap 30. In this arrangement, head guard 10 envelops the front and side of the head for maximum protection.

In operation, optional protrusions 15*a*-15*d* assist in dispersing impact force should the user suffer a head impact, such as impact by a baseball.

The head guard of the invention is suitable for use with all baseball caps, preferably, baseball caps comprising a head band. Baseball caps may constructed of variety of materials as is well known in the art. Major league baseball players wear classic-style caps made of wool (or, more recently, polyester) with their team's simple logo and colors; the logo is usually embroidered into the fabric. Caps used by players may sometimes have sunglasses attached to the peak that can be flipped down when the player must look into the sky, but kept flipped up at other times.

Formerly, baseball caps came in standard cap sizes; since 1980, they have commonly come in a "one-size-fits-all" form, with an adjustment strap in the back.

Athletes in other sports wear caps with their team's logo and colors as "sideline" caps; both types are also sold as authentic team merchandise in retail stores and are quite popular. Other caps may simply have a company's logo, such as Nike or Carhartt; these hats are often made of brushed cotton.

Another version of the baseball cap, worn often—but not exclusively—by farmers and migrant agricultural workers, is the plastic mesh cap with foam fronts and a farm feed supply company logo or the like printed on the cap. This style of baseball cap is sometimes called a "trucker cap" because of its blue collar associations. It is also known as a "gimme cap" due to its being given away for free as a method of advertising.

For use in the invention, the user selects an adjustable cap or the appropriate sized fitted baseball cap. To select the appropriate sized fitted cap, the user carefully measures his or her head with a tape measure—about a half-inch above the eyebrows. Users that are in between sizes should select the larger size. Cap size in relation to head measurements are shown in the table below.

| Head size - cm | Head size - inches | Cap size |
|---|---|---|
| 56 | 22 | 7 |
| 58 | 22¾ | 7¼ |
| 59 | 23⅛ | 7⅜ |
| 60 | 23½ | 7½ |
| 61 | 23⅞ | 7⅝ |
| 62 | 24¼ | 7¾ |

The head guard of the invention is readily prepared by injection molding or other similar procedure by well known methods in the art. Any shock-absorbing fabric or material is suitable for use in the head guard of the invention, preferred materials include but are not limited to foam rubber, gel foam and rubberized gel foam.

Preferably, the head guard of the invention is made of rubberize gel foam and constructed in a one-piece process, such as injection molding. In one embodiment, a foam piece is laminated with a fabric on the single side, heat pressed, and then the whole sheet is cut in the designed shape.

The present invention is not to be limited in scope by the specific embodiments disclosed in the description and drawings, which are intended as illustrations of a few aspects of the invention. Any embodiments that are functionally equivalent are within the scope of this invention. Indeed, various modifications of the invention in addition to those shown and described herein will become apparent to those skilled in the art and are intended to fall within the scope of the appended claims.

What is claimed is:

1. A protective head guard, consisting essentially of:

a conventional fabric baseball cap (30) having a body with a base, a top, a back, a front and a bill at the front, wherein the baseball cap comprises an inner portion of the body of the cap (40) and an internal circumferentially disposed sweatband (35) having a base edge coinciding with and connected to the base of the cap and a top edge, the inner portion (40) and the sweatband (35) defining a space closed at the base of the cap and open at the top edge of the sweatband; and a shock-absorbing form (10) conformable from an elongate flat configuration into a conical configuration for insertion into the cap (30), the form comprising:

a base portion having an arcuate profile extending the entire length of said base portion when the form is in the flat configuration and an inner radius side having a concave configuration when the form is in said flat configuration and an outer radius side with respect to the arcuate profile, said base portion comprising on its outer radius side one or more insertable sections (20) sized and configured for insertion into the space, and a plurality of flaps (26) extending from the inner radius side of the base portion, said plurality of flaps sized and configured to conform to the inner portion of the body of the cap (40), wherein said shock-absorbing form is inserted in the baseball cap such that the one or more insertable sections (20) are inserted into the space and the flaps (26) extend toward the top of the cap conforming to the inner portion of the body of the cap above the top edge of the sweatband, thereby forming the protective head guard.

2. The protective head guard of claim 1, wherein the shock-absorbing form comprises, foam rubber, gel foam or rubberized gel foam.

3. The protective head guard of claim 1, further comprising one or more protrusions.

4. The protective head guard of claim 3, wherein each of the flaps comprises one or more protrusions.

5. The protective head guard of claim 1, wherein a plurality of notches (25) are disposed along the base portion of the form whereby multiple insertable sections of the base portion are defined.

6. The protective head guard of claim 1, wherein the plurality of flaps (26) comprise a centrally disposed, middle flap.

7. The protective head guard of claim 6, wherein the middle flap extends farther from the base portion than the other flaps.

8. The protective head guard of claim 1, wherein the internal circumferential sweatband is discontinuous at the back of the cap.

* * * * *